US007370388B2

(12) United States Patent
Yuasa et al.

(10) Patent No.: US 7,370,388 B2
(45) Date of Patent: May 13, 2008

(54) AIR CLEANER FOR PORTABLE ENGINE

(75) Inventors: Tsuneyoshi Yuasa, Kobe (JP); Masanori Kobayashi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 270 days.

(21) Appl. No.: 10/941,829

(22) Filed: Sep. 16, 2004

(65) Prior Publication Data

US 2005/0060973 A1 Mar. 24, 2005

(30) Foreign Application Priority Data

Sep. 19, 2003 (JP) ..... 2003-327928

(51) Int. Cl.
*A47L 5/00* (2006.01)
*A47L 9/00* (2006.01)

(52) U.S. Cl. ..... 15/347; 15/347; 15/352; 55/385.1; 55/385.3; 55/DIG. 3; 123/41.7; 123/41.56; 123/198; 74/519; 74/526; 74/522.5

(58) Field of Classification Search ..... 15/347, 15/352; 55/DIG. 2, DIG. 3, 385.1, 385.3; 123/198 E, 41.7, 41.56; 74/519, 526, 522.5
See application file for complete search history.

(56) References Cited

U.S. PATENT DOCUMENTS 2,887,714 A * 5/1959 Hanson ..... 15/314
3,496,703 A * 2/1970 Maguire et al. ..... 96/296
4,713,858 A * 12/1987 Kelber ..... 15/347
5,195,209 A * 3/1993 Watkins ..... 15/339
5,661,960 A * 9/1997 Smith et al. ..... 56/12.7
6,079,374 A * 6/2000 Yamamoto et al. ..... 123/41.7
6,395,049 B2 * 5/2002 Knodler et al. ..... 55/385.3
6,431,024 B1 * 8/2002 Yuasa et al. ..... 74/519
6,574,829 B1 * 6/2003 Marcum et al. ..... 15/347
6,955,698 B2 * 10/2005 Hettmann et al. ..... 55/385.3
7,077,078 B2 * 7/2006 Yuasa et al. ..... 123/41.7
2004/0088817 A1 * 5/2004 Cochran et al. ..... 15/327.5
2004/0173178 A1 * 9/2004 Hettmann et al. ..... 123/198 E
2005/0224039 A1 * 10/2005 Warfel et al. ..... 123/198 E
2005/0283942 A1 * 12/2005 Palazzolo ..... 15/347

FOREIGN PATENT DOCUMENTS

JP 2002-303148 10/2002

* cited by examiner

*Primary Examiner*—Duane Smith
*Assistant Examiner*—Minh-Chau T Pham
(74) *Attorney, Agent, or Firm*—Oliff & Berridge, PLC

(57) ABSTRACT

An air cleaner for a portable engine, includes an air cleaner case attached to an upper part of an engine body of the engine. Preferably, the air cleaner case is supported on an upper wall of a shroud covering the engine. Preferably, the air cleaner case is formed integrally with the shroud. Preferably, the air cleaner further includes an air intake structure divided into a plurality of intake passages having inlets displaced relative to each other with respect to an air flow direction in which an intake air flows.

10 Claims, 7 Drawing Sheets

AIR CLEANER FOR PORTABLE ENGINE

BACKGROUND OF THE INVENTION

1. Field of the Invention

The present invention relates to an air cleaner for a portable engine and, more particularly, to an air cleaner suitable for a portable engine for driving a backpack blower, a backpack power applicator or a hand held bush cutter.

2. Description of the Related Art

FIG. 10 shows a known portable engine E disclosed in JP-A No. 2002-303148 by way of example. This engine is used for driving a backpack blower A as shown in FIG. 9. The backpack blower A includes an engine E, a blower 1, a back frame 15 holding the engine E and the blower 1, a flexible pipe 16 connected to the discharge pipe of the blower 1, a duct 17, and a nozzle 18. An operator supports the back frame 15 holding the engine E and the blower 1 on the operator's shoulders by straps 19 connected to the back frame 15. Air is blown through the nozzle 18 to blow and collect dead leaves M and trash.

Referring to FIG. 10, an exhaust muffler 11 is joined to one of the opposite sides of a cylinder 8, and an intake pipe (insulator) 7, a carburetor 12 and an air cleaner 13 are connected in that order to the other side of the cylinder 8. The cylinder 8 and the exhaust muffler 11 are covered with a shroud 21. The air cleaner 13 has an intake duct 100 opening downward.

In the prior constitution shown in FIG. 10, since the air cleaner 13 is arranged in the lateral of the carburetor 12 and is joined to the carburetor 12 connected to the intake pipe 7, the air cleaner 13 juts out greatly laterally and increases the width of the engine E. When the engine E is used for driving the backpack blower 1 as shown in FIG. 9, the greatly laterally jutting air cleaner 13 obstructs the cleaning work.

When the volume of the air cleaner 13 is increased to enhance the output of the engine, to reduce the noise of the intake air of the engine, or to extend the useful life of the air cleaner element, the air cleaner 13 needs to be formed of a high-strength material or to be provided with reinforcing members to make the air cleaner 13 sufficiently durable, because the air cleaner 13 juts out laterally from the carburetor 12 connected to the intake pipe 7 as shown in FIG. 10. As a result, the cost and the weight of the air cleaner 13 increase.

Since the intake duct 100 of the air cleaner 13 opens simply downward, it is possible that blown dead leaves and trash stick to the open lower end of the intake duct 100 to reduce the flow of intake air suddenly.

SUMMARY OF THE INVENTION

Accordingly, it is an object of the present invention to provide an air cleaner for a portable engine which is able to solve the foregoing problems.

According to the present invention, an air cleaner for a portable engine comprises an air cleaner case attached to an upper part of an engine body of the engine.

Preferably, the air cleaner case is supported on an upper wall of a shroud covering the engine.

Preferably, the air cleaner case is formed integrally with the shroud.

Preferably, the air cleaner case is supported by the upper part of the engine body and a carburetor connected to an intake port formed in the engine body.

Preferably, a carburetor cover is formed integrally with the air cleaner case, and an access hole through which an idle adjusting screw of a carburetor of the engine is operated is formed in the carburetor cover in a part corresponding to the idle adjusting screw.

The air cleaner for a portable engine further comprises an air intake structure divided into a plurality of intake passages, the intake passages having inlets displaced relative to each other with respect to an air flow direction in which an intake air flows.

Preferably, the plurality of intake passages includes an inner passage and an outer passage enclosing the inner passage, the inner passage having an inlet positioned behind an inlet of the outer passage with respect to the air flow direction.

Preferably, a recess is formed in an edge defining the inlet of the outer passage.

The air cleaner for a portable engine further comprises a plurality of sets of the inner passage and the outer passage, the plurality of sets being arranged contiguously with each other.

Preferably, the plurality of intake passages are contiguous with and parallel to each other, and inlets of adjacent intake passages are displaced relative to each other with respect to the air flow direction.

Since the air cleaner case is attached to the upper part of the engine body, the engine for, for example, a backpack blower can be formed in a narrow width. The backpack blower driven by the engine provided with the air cleaner of the present invention can be easily carried on the operator's back and facilitates cleaning work. The air cleaner case has necessary rigidity and strength even if the air cleaner is designed so as to have large volume to extend the useful life of the air cleaner element, for example, and the air cleaner case is not formed of a particular strong material.

Supporting the air cleaner case by both the upper part of the engine body and the carburetor increases the rigidity of the air cleaner.

Formation of the air cleaner case integrally with the shroud is effective in reducing manufacturing and assembling costs.

When the air cleaner case is formed integrally with the carburetor cover and the access hole is formed in the carburetor cover, the carburetor does not need to be protected by a carburetor protecting member, and a screw driver can be easily engaged with the idle adjusting screw to facilitate idling speed adjustment.

The division of the intake structure into the plurality of intake passages is effective in attenuating unpleasant intake noise of frequencies in an undesirable frequency range. Displacement of the inlets of the intake passages relative to each other with respect to an air flow direction in which intake air flows is effective in preventing the inlets of all the intake passages from being shut when the inlets of some of the intake passages are covered with dead leaves or the like. Thus, the complete shutting of intake passages can be prevented.

When the intake passages includes the inner passage and the outer passage enclosing the inner passage, and the inlet of the inner passage is positioned behind the inlet of the outer passage with respect to the air flow direction, the resistance of passages against the flow of intake air increases and intake noise of the engine can be suppressed. The inner and the outer passages respectively having different sectional areas reduce noises of different frequencies, respectively.

The recess formed in the edge defining the inlet of the outer passage can secure a gap through which intake air is introduced into the intake passages even when dead leaves and the like stick to the inlet of the outer passage.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 9:
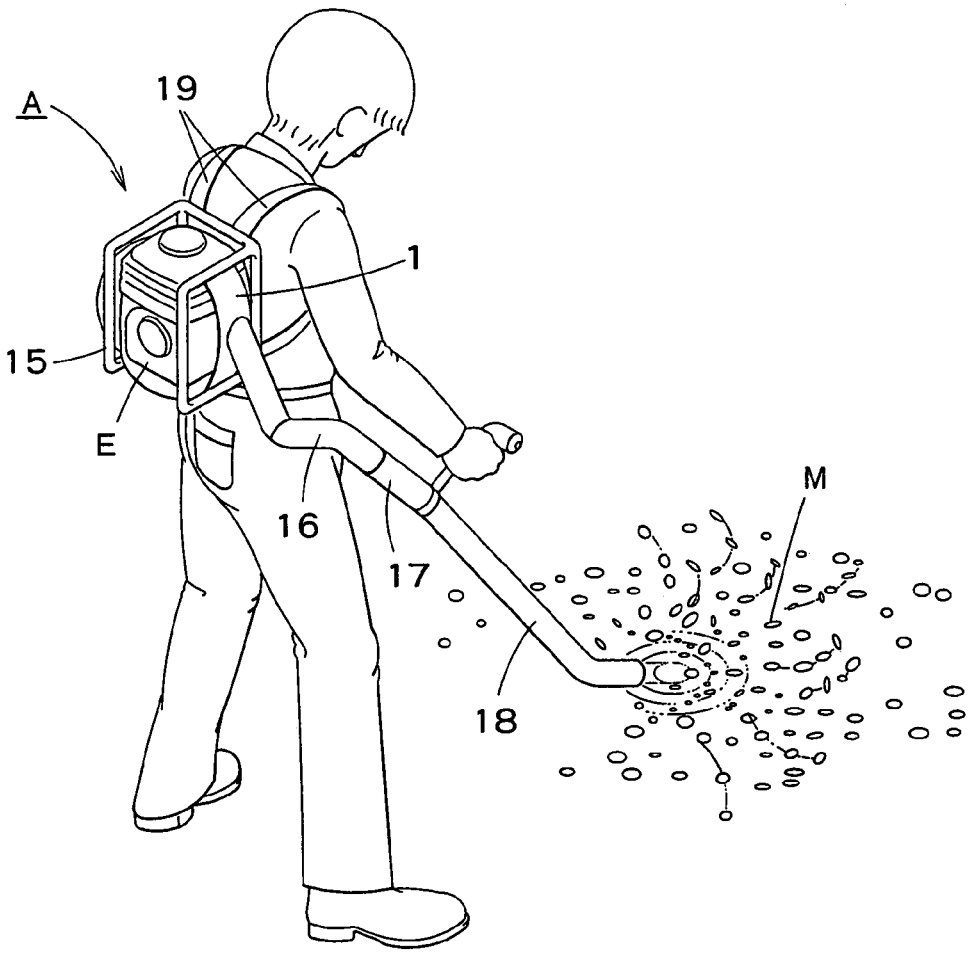
FIG. 9 is a perspective view of a backpack blower in use.

An air cleaner according to an embodiment of the present invention will be described with reference to the drawings as applied to an engine E included in a backpack blower as shown in FIG. 9.

Blower and Engine

Figure 1:
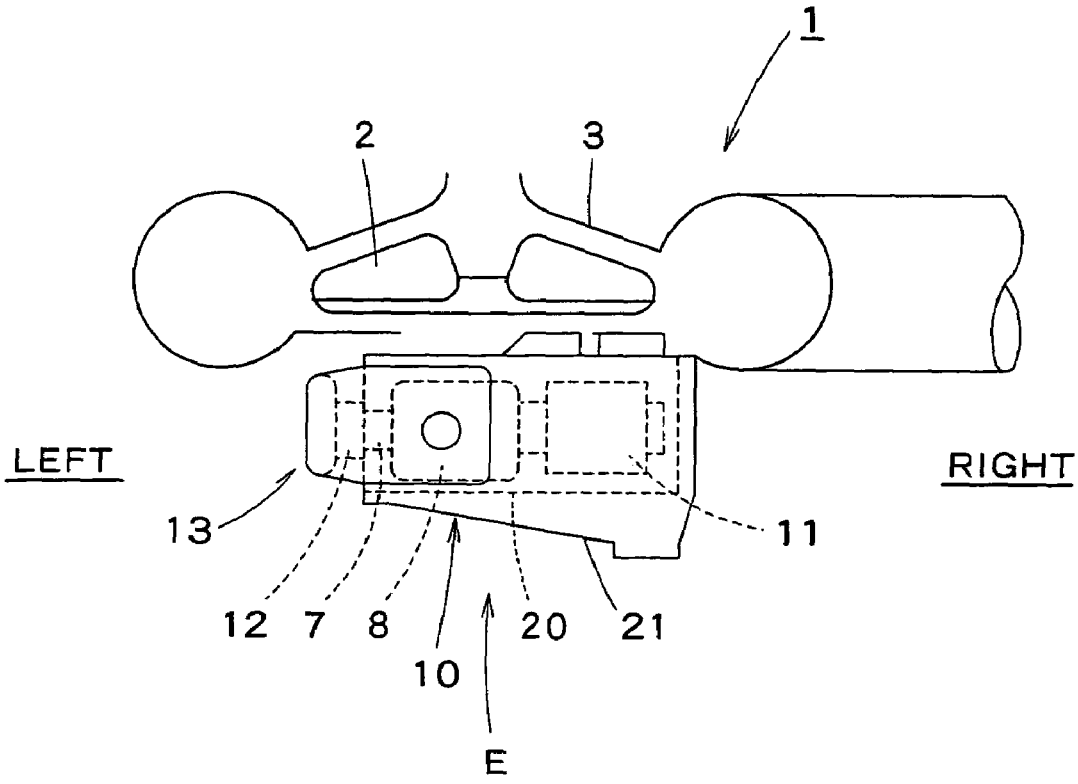
FIG. 1 is a schematic plan view of a backpack blower including a blower, and a portable engine for driving the blower, provided with an air cleaner in a first embodiment according to the present invention.
Figure 10:
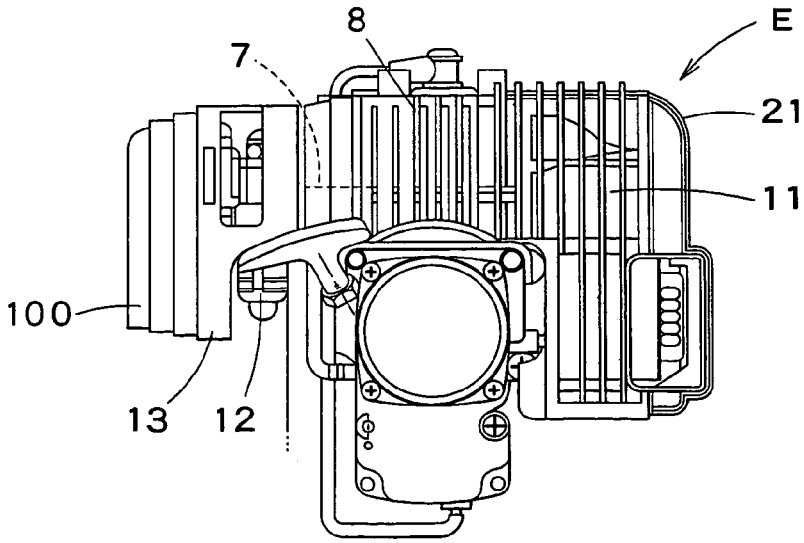
FIG. 10 is a rear view of a portable engine provided with a prior air cleaner.

Referring to FIG. 1, a blower 1 includes a fan 2 and a fan casing 3, and an engine E for driving the fan 2 is joined to a back part of the fan casing 3. The engine E includes an engine body 10 having a cylinder 8. An exhaust muffler 11 is connected to the right side of the cylinder 8, and an intake pipe 7 serving as an insulator is connected to the left side of the cylinder 8. A carburetor 12 is connected to the intake pipe 7. The cylinder 8 and the exhaust muffler 11 of the engine E are covered with an engine cover 20 formed by processing a metal plate. The engine cover 20 is covered with a shroud 21 of a resin. These constructions are basically the same as those shown in FIG. 10.

Figure 2:
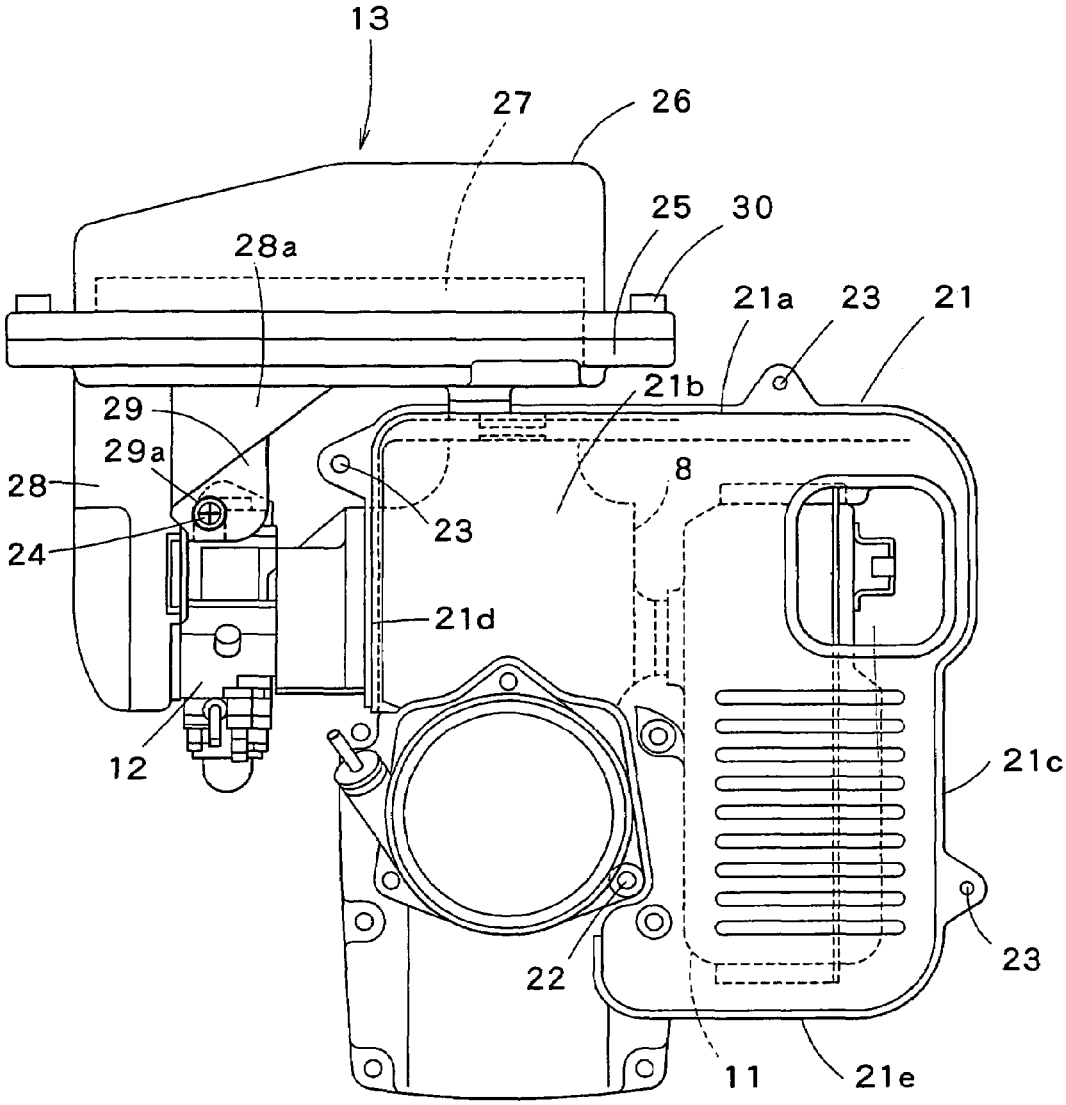
FIG. 2 is a rear view of the portable engine shown in FIG. 1.

Referring to FIG. 2 showing the engine E in a rear view, the shroud 21 has an upper wall 21*a*, a back wall 21*b*, a right wall 21*c*, a left wall 21*d* and a lower wall 21*e* extending under the exhaust muffler 11, which are formed integrally. The shroud 21 is fastened together with a recoil starter to the engine E with bolts 22, and to the blower 1 with bolts 23.

The air cleaner 13 has an air cleaner case 25, an air cleaner cover 26 put on the air cleaner case 25 and fastened to the air cleaner case 25 with bolts 30, an air cleaner element 27 held in the air cleaner case 25, and a duct 28 extending downward from a left part of the air cleaner case 25 substantially perpendicularly to the bottom wall of the air cleaner case 25. The air cleaner case 25 is formed of a resin by molding. A right part of the air cleaner case 25 is supported in a horizontal position on the upper wall 21*a* of the shroud 21, and a left part of the air cleaner case 25 juts out horizontally to the left from the shroud 21 above the carburetor 12. The duct 28 is formed integrally with the air cleaner case 25. A lower end part of the right wall of the duct 28 is connected to the left side surface of the carburetor 12.

Figure 3:
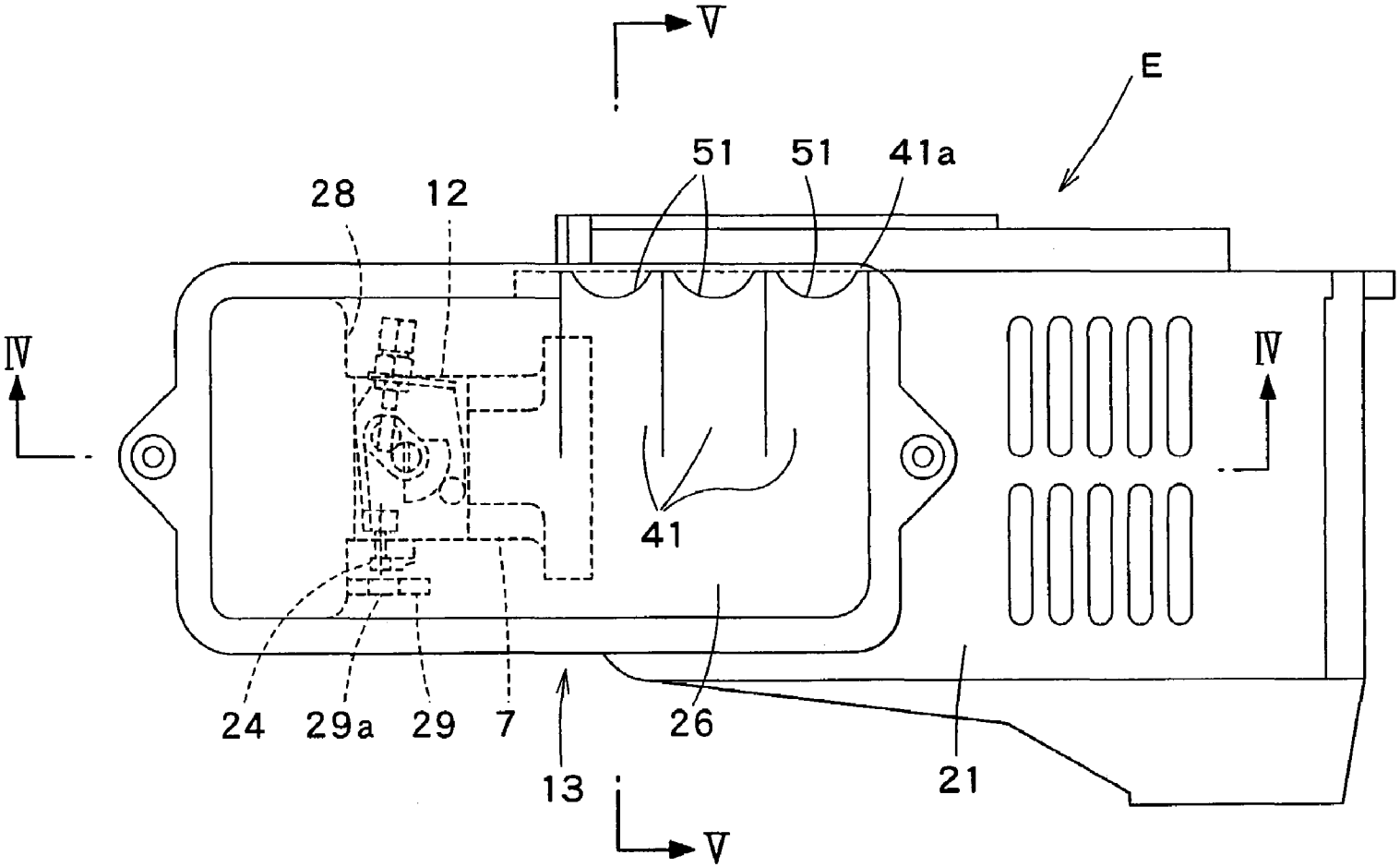
FIG. 3 is a plan view of the portable engine shown in FIG. 1.

A triangular extension duct 28*a* serving also as a reinforcing member is formed integrally with the duct 28 between an upper half part of the duct 28 and a left half part of the air cleaner case 25. A carburetor cover 29 disposed behind the carburetor 12 is formed integrally with the extension duct 28*a*. As shown in FIG. 3, the carburetor cover 29 is provided in a part corresponding to the head of an idle adjusting screw 24 included in the carburetor 12 with an access hole 29*a*.

Figure 4:
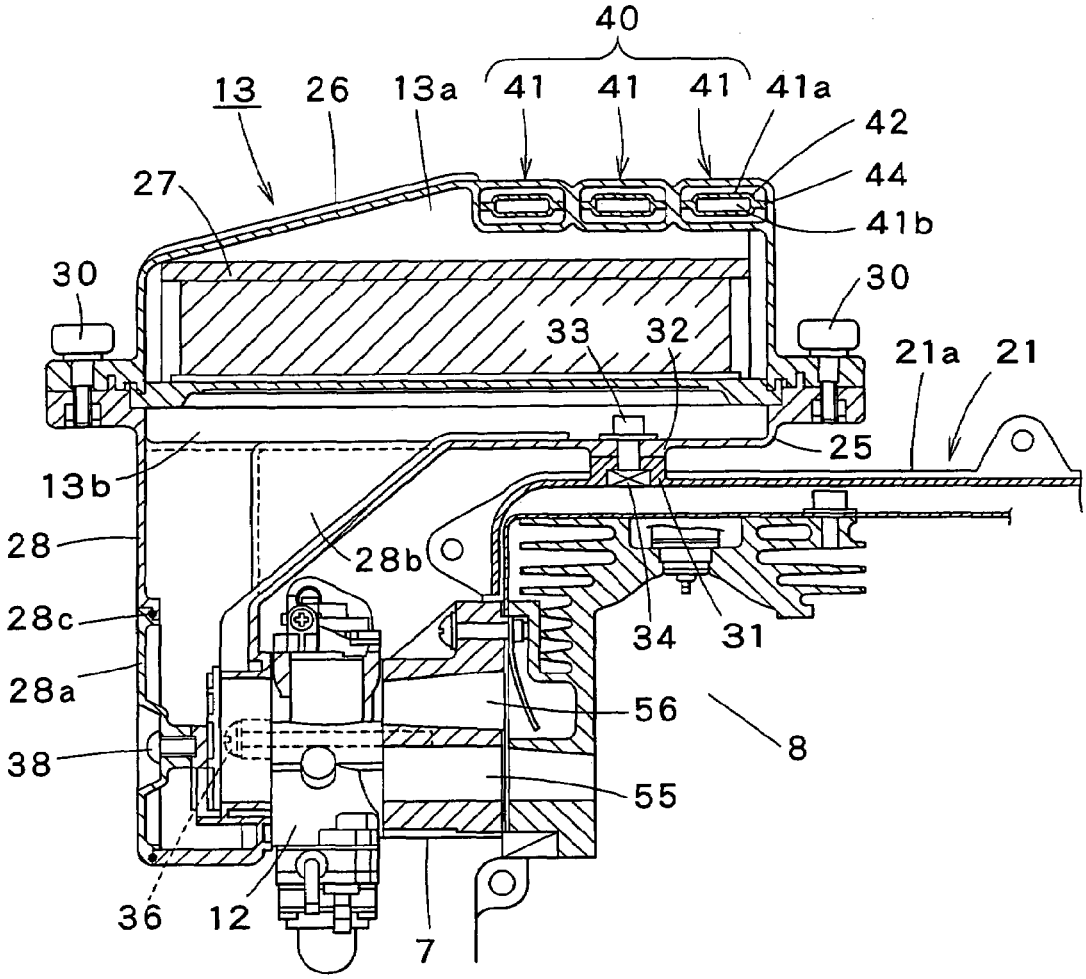
FIG. 4 is a sectional view taken on the line IV-IV in FIG. 3.

Referring to FIG. 4, an air cleaner mount 31 is formed integrally with the upper wall 21*a* of the shroud 21 so as to protrude upward. A boss 32 formed near the right end of the bottom wall of the air cleaner case 25 is seated on the air cleaner mount 31. A right part of the air cleaner case 25 is fastened to the upper wall 21*a* of the shroud 21 with a bolt 33 and a nut 34.

A lower end part of the duct 28 is fastened together with the carburetor 12 to the intake pipe 7 with a lateral bolt 36. A side lid 28*a* is fastened to a lower part of the left side wall of the duct 28 with a bolt 38 with an O ring 28*c* held between the side lid 28*a* and the left side wall of the duct 28.

An air intake structure 40 is formed in a right part of the upper wall of the air cleaner cover 26. The air intake structure 40 includes three parallel intake ducts (intake passages) 41 having a rectangular cross section. Tubular walls 42 having an elliptic cross section are extended in the intake duct 41 to define an outer passage 41*a* and an inner passage 41*b* in each of the intake duct 41. The tubular walls 42 are connected to the intake duct 41 with right and left horizontal ribs 44. Thus each of the outer passages 41*a* is divided into an upper passage and a lower passage by the ribs 44.

Figure 5:
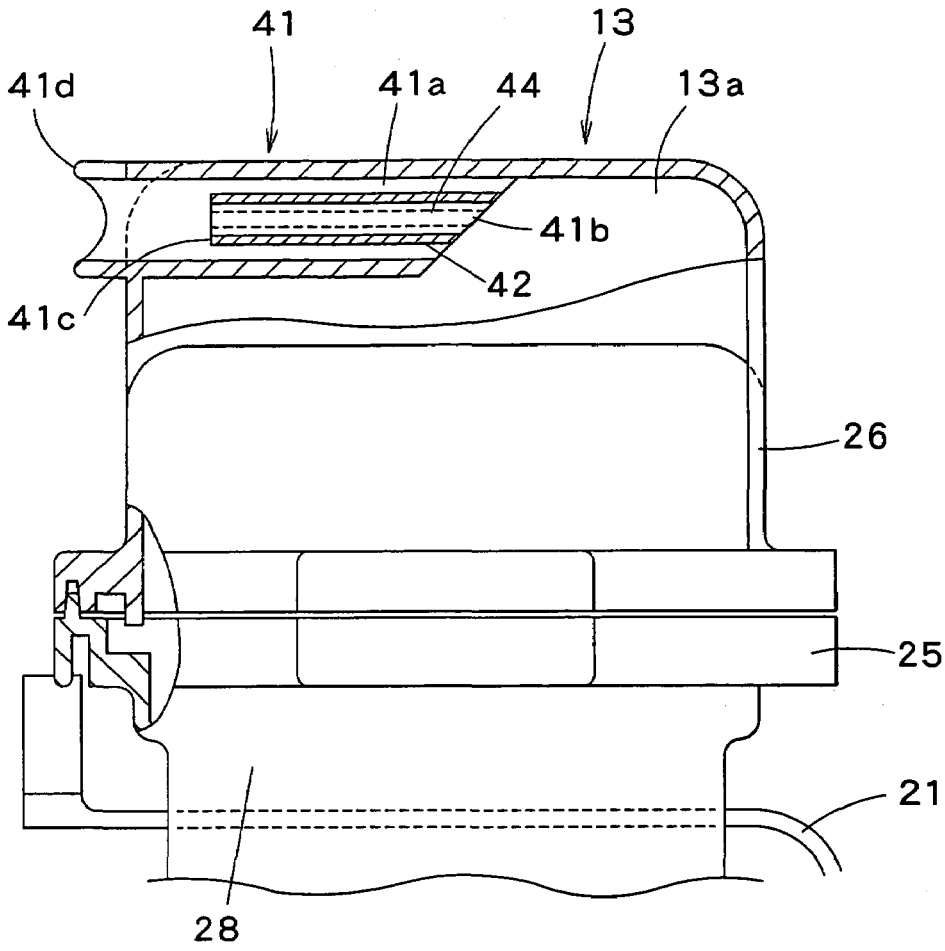
FIG. 5 is a sectional view taken on the line V-V in FIG. 3.

Referring to FIG. 5, an inlet 41*c* of the inner passage 41*b* is disposed at a predetermined distance behind an inlet 41*d* of the outer passage 41*a* with respect to a direction in which intake air flows.

Figure 6:
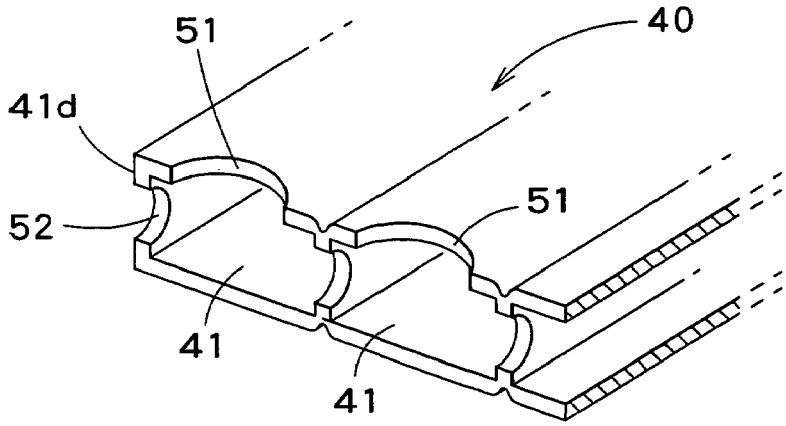
FIG. 6 is a fragmentary perspective view of an intake structure included in the air cleaner, showing an inlet portion of the intake structure.

Referring to FIG. 6, arc-shaped segmental recesses 51 and 52 are formed in the end edges of the upper and the side walls of the intake ducts 41.

Mounting of Air Cleaner

Referring to FIG. 4, the air cleaner cover 26, the air cleaner element 27 and the side lid 28*a* are separated from the air cleaner case 25. The boss 32 of the air cleaner case 25 is mounted on the air cleaner mount 31 of the upper wall 21*a* of the shroud 21, the boss 32 (the right end part of the air cleaner case 25) is fastened to the air cleaner mount 31 (the upper wall 21*a* of the shroud 21) with the bolt 33 and the nut 34, and the lower part of the duct 28 is fastened together with the carburetor 12 to the intake pipe 7 with the lateral bolt 36.

Then, the air cleaner element 27 is placed in the air cleaner case 25, the air cleaner cover 26 is fastened to the air cleaner case 25, and the side lid 28*a* is fastened to the left side wall of the duct 28.

Operation

Referring to FIG. 3, while the engine E is in operation, atmospheric air is sucked through the inlets 41*d* of the intake ducts 41, and as shown in FIG. 5, the sucked air flows through the outer passages 41*a* and the inner passages 41*b* into the dirty side 13*a* of the air cleaner 13.

Thus, air sucked into the three intake ducts 41 is distributed to the outer passages 41*a* and the inner passages 41*b*. Consequently, unpleasant intake noise of frequencies in a specific frequency range can be suppressed, and sounds of different frequencies can be efficiently suppressed by the outer passages 41*a* and the inner passages 41*b* respectively having different sectional areas.

Even if dead leaves and the like stick to the inlets 41*d* of the intake ducts 41 while air is being sucked through the intake ducts 41, gaps can be surely formed between the dead leaves and the inlet ends of the intake ducts 41 because the segmental recesses 51 and 52 are formed in the end edges of the upper and the side walls of the intake ducts 41. Consequently, air can be sucked into the intake ducts 41 without being impeded.

Referring to FIG. 4, intake air taken into the dirty side 13*a* is filtered by the air cleaner element 27 and the filtered clean intake air flown into the clean side 13*b* flows through the duct 28 into the carburetor 12. Part of the clean intake air is mixed with fuel to produce an air-fuel mixture, the air-fuel mixture flows through a lower passage 55 for the air-fuel mixture passage in the intake pipe 7 into the cylinder 8, and the rest of the clean intake air flows through an upper passage 56 for intake air into the cylinder 8.

Adjustment of Idling

When idling speed needs to be adjusted, a screw driver is inserted through the access hole 29*a* of the carburetor cover 29 in the space inside the carburetor cover 29, and the idle adjusting screw 24 is turned with the screw driver.

Figure 7:
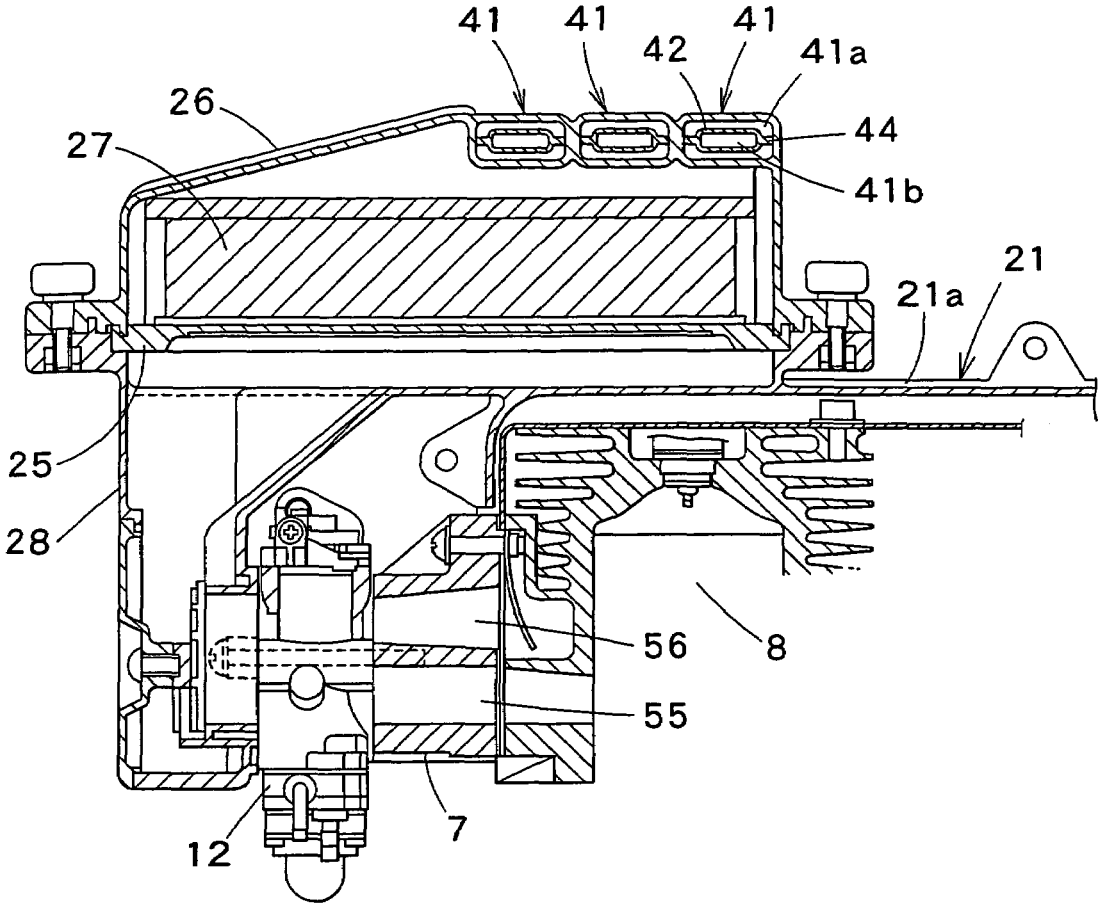
FIG. 7 is a sectional view, similar to FIG. 4, of an air cleaner in a second embodiment according to the present invention.

An air cleaner in a second embodiment according to the present invention will be described with reference to FIG. 7, in which parts like or corresponding to those of the air cleaner in the first embodiment shown in FIG. 4 are denoted by the same reference characters. As shown in FIG. 7, the air cleaner in the second embodiment has an air cleaner case 25 formed integrally with a shroud 21. Namely, the cleaner case 25 and the shroud 21 are formed as a single unit by molding. Walls are raised from a left part of the upper wall 21*a* of the shroud 21 to form the air cleaner case 25, and an air cleaner cover 26 is fastened to the open upper end of the air cleaner case 25.

Since the air cleaner case 25 is formed integrally with the shroud 21, the air cleaner in the second embodiment has less parts, needs less assembling steps and less weight than the air cleaner in the first embodiment.

Figure 8:
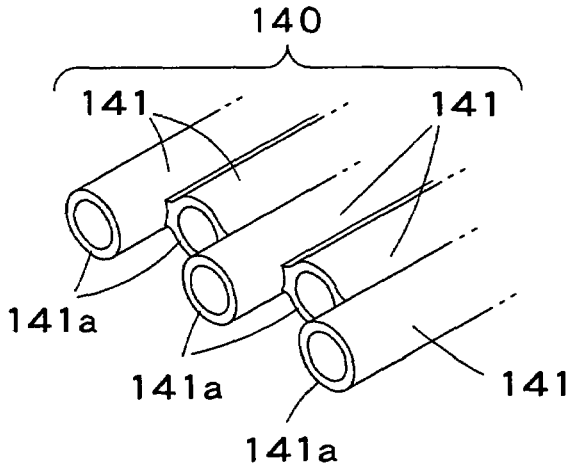
FIG. 8 is a fragmentary perspective view of an intake structure in a modification.

FIG. 8 shows an intake structure 140 in a modification of the foregoing intake structure. This intake structure 140 includes a plurality of parallel intake ducts (intake passages) 141 having the shape of a round tube. The intake ducts 141 have inlets 141*a* displaced relative to each other with respect to a direction in which intake air flows. The division of the intake structure 140 into the plurality of intake ducts 141 is effective in attenuating unpleasant intake noise of frequencies in an undesirable frequency range. Displacement of the inlets 141*a* of the intake ducts 141 relative to each other with respect to a direction in which intake air flows is effective in preventing the inlets 141*a* of all the intake ducts 141 from being shut when the inlets 141*a* of some of the intake ducts 141 are covered with dead leaves or the like. Thus the complete shutting of the intake passages can be prevented.

Although the air cleaner in the foregoing embodiments have the L-shaped air cleaner cases, an air cleaner may be disposed on top of the engine, and the air cleaner may be connected to the carburetor by a flexible duct.

The present invention is applicable not only to portable engines for the backpack blower, but also to portable engines for other purposes.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An air cleaner for cleaning the intake air of a portable engine, composing:

an air cleaner case attached to an upper part of an engine body having a cylinder of the engine:

an air cleaner cover disposed on and attached to the air cleaner case; and an air cleaner element held in the air cleaner case and the air cleaner cover, wherein an upstream air passage is formed in the air cleaner cover and a downstream air passage is formed in the air cleaner case, the upstream air passage being disposed upstream of the air cleaner element, the downstream air passage being disposed downstream of the air cleaner element, wherein the air cleaner case is supported on an upper wall of a shroud, the shroud covering upper and side portions of the cylinder so as to form an outer cover of the engine body.

2. The air cleaner for a portable engine according to claim 1, wherein the air cleaner case is supported by the carburetor connected to a side of the cylinder and the shroud covering the cylinder, and wherein the air cleaner case includes a horizontally extending member having a horizontally extending air passage, the horizontally extending member extending over the shroud and the carburetor so as to be supported on the shroud, and a vertically extending member having a vertically extending air passage, the vertically extending member extending downwardly from the horizontally extending member along a side of the carburetor so as to be supported on the carburetor, and an obliquely extending member having an obliquely extending air passage, the obiquely extending member extending obliquely from the horizontally extending member toward the vertically extending member over the carburetor.

3. The air cleaner for a portable engine according to claim 2, wherein the air cleaner case further includes a carburetor cover formed integrally with the air cleaner case, the carburetor cover extending downwardly from the obliquely extending member so as to cover a back of an idle adjusting screw of the carburetor, and an access hole through which the idle adjusting screw is operated being formed in the carburetor cover at a location corresponding to the idle adjusting screw.

4. The air cleaner for a portable engine according to claim 1, further comprising an air intake structure having an air intake passage part through which the intake air is introduced into the air cleaner, the air intake passage part being formed in the air cleaner cover so as to extend from an inlet part thereof exposed to an atmosphere to an exit part thereof opening to a space within the air cleaner cover, the air intake passage part being divided into a plurality of intake passages extending parallel to each other from the inlet part to the exit part, the intake passages respectively having inlets displaced relative to each other with respect to an air flow direction in which the intake air flows.

5. The air cleaner for a portable engine according to claim 4, wherein the plurality of intake passages include an inner passage and an outer passage enclosing the inner passage, the inner passage having the inlet positioned downstream of the inlet of the outer passage with respect to the air flow direction.

6. The air cleaner for a portable engine according to claim 5, wherein a recess is formed in an edge defining the inlet of the outer passage, the recess being formed from a distal end of the edge of the inlet of the outer passage in the air flow direction.

7. The air cleaner for a portable engine according to claim 5, further comprising a plurality of sets of the inner passages and the outer passages, the plurality of sets being arranged contiguously with and parallel to each other.

8. The air cleaner for a portable engine according to claim 4, wherein the plurality of intake passages are contiguous with and parallel to each other, and the inlets of adjacent intake passages are displaced relative to each other with respect to the air flow direction.

9. The air cleaner according to claim 1, wherein the shroud is comprised of a resin.

10. The air cleaner for a portable engine according to claim 9, wherein the air cleaner case is comprised of a resin and molded integrally with the shroud as a single piece.

* * * * *